US005481643A

United States Patent [19]

Ten Kate et al.

[11] Patent Number: 5,481,643

[45] Date of Patent: Jan. 2, 1996

[54] TRANSMITTER, RECEIVER AND RECORD CARRIER FOR TRANSMITTING/RECEIVING AT LEAST A FIRST AND A SECOND SIGNAL COMPONENT

[75] Inventors: Warner R. T. Ten Kate, Aalst, Netherlands; Karl-Ejner Christensen, Brønderslev; Erik Sørensen, Spøttrup, both of Denmark

[73] Assignee: U.S. Philips Corporation, New York, N.Y.

[21] Appl. No.: 427,646

[22] Filed: Apr. 24, 1995

Related U.S. Application Data

[63] Continuation of Ser. No. 180,004, Jan. 11, 1994, abandoned, which is a continuation-in-part of Ser. No. 32,915, Mar. 18, 1993, abandoned.

[51] Int. Cl.[6] ..... G10L 3/02; G10L 9/00

[52] U.S. Cl. ..... 395/2.36; 455/72; 381/2

[58] Field of Search ..... 381/30, 31, 2; 455/72, 43, 91; 395/2.21, 2.35, 2.36

[56] References Cited

U.S. PATENT DOCUMENTS 5,185,800 2/1993 Mahieux ..... 381/30

5,241,689 8/1993 Schwed et al. ..... 455/72

FOREIGN PATENT DOCUMENTS 0124597 5/1990 Japan ..... 381/31

*Primary Examiner*—Curtis Kuntz
*Assistant Examiner*—Ping W. Lee
*Attorney, Agent, or Firm*—Leroy Eason

[57] ABSTRACT

A transmitter for transmitting at least two main signal components (L,R) includes a first data compression circuit (BRR1) for performing a data compression of a first of the main signal components, a data expansion circuit (DEQ) for performing a data expansion of the compressed signal component so as to obtain a replica of the first main signal component, and a matrixing circuit for combining the second main signal component with the replica of the first main signal component so as to obtain a combined signal (M'). A second data compression circuit (BRR2) performs a data compression of the combined signal (M') in response to a masking control signal. The output signals of the first and second data compression circuits are combined as a composite signal for transmission via a transmission medium, for example a record carrier. The invention also provide a receiver for such a transmitted composite signal. The transmitter may be adapted to provide for transmission of three individual signal components (L,R,C).

12 Claims, 7 Drawing Sheets

TRANSMITTER, RECEIVER AND RECORD CARRIER FOR TRANSMITTING/RECEIVING AT LEAST A FIRST AND A SECOND SIGNAL COMPONENT

This is a continuation of application Ser. No. 08/180,004, filed Jan. 11, 1994 which is a continuation-in-part of application Ser. No. 08/032,915, filed Mar. 18, 1993, both now abandoned.

FIELD OF THE INVENTION

The invention relates to a transmitter for transmitting at least a first and a second signal component, in which a combined use of matrixing and bit rate reduction is carried out. The invention further relates to a receiver for receiving the signals transmitted by the transmitter, and to a record carrier on which the signals are recorded.

BACKGROUND OF THE INVENTION

Matrixing can be carried out on a stereo signal having a left hand and a right hand signal component L and R respectively, so as to obtain a mono signal M=a(L+R) and an difference signal A=a(L–R), where $a \leqq 1$, such as $\sqrt{2/2}$.

Compression means for bit rate reducing a signal has been described in published European patent applications 457,390A1 (PHN 13.328) and 457,391A1 (PHN 13.329). Bit rate reducing the above signals M and A by such compression means results in these signals being contaminated with quantization noise. The aim of the compression means is to keep the quantization noise below the threshold of hearing. After transmission and receiving the quantized signals, the quantized signals are dequantized in the receiver, so as to obtain a replica of the signals M and A. The original stereo signal is retrieved by dematrixing the dequantized signals M and A. It has been found that the received stereo signal is sometimes affected by quantization noise which has become audible.

Matrixing is also present when transmitting a first main signal component (the left hand signal component L of a stereo signal), a second main signal component (the right hand signal component R) and an auxiliary component (a central signal component C), such that a first signal component $L_c$ is obtained which equals L+b.C and a second signal $R_c$ is obtained which equals R+b.C, and where the signals $L_c$, $R_c$ and C are transmitted. Upon reception by a standard receiver not having a corresponding dematrixing circuit, the signal components $L_c$ and $R_c$ are used for supplying sound via two stereo loudspeakers to a listener. The listener is thus able to perceive the C transmitted component as well, even though he has a standard receiver.

More sophisticated matrixing schemes are discussed in J.A.E.S., Vol. 40, No. 5, May 1992, pp. 376–382.

SUMMARY OF THE INVENTION

The invention has for its object to provide a transmitter including matrixing means and compression means and which is capable of encoding two or more signals in such a way that upon decoding in a receiver, quantization noise is, in general, not audible.

Such a transmitter for transmitting at least a first and a second main signal component, therefore comprises at least a first and a second input terminal for receiving the first and the second main signal component, first compression means having an input coupled to the second input terminal, and an output, the first compression means being adapted to carry out a data reduction step on the main signal component applied to its input in response to a first masking control signal and to supply a compressed main signal component to its output, first masking control signal generator means for generating the first masking control signal for the first compression means and for generating a first instruction signal, the masking control signal generator means being adapted to derive the masking control signal and the first instruction signal from the main signal component applied to the input of the first compression means, expansion means having an input coupled to the first compression means, the expansion means being adapted to carry out a data expansion on the data information applied to its input so as to obtain a replica of the main signal component applied to the input of the first compression means, matrixing means having at least a first and a second input, the first input being coupled to the first input terminal, the second input being coupled to the output of the expansion means, the matrixing means further having an output for supplying an output signal, the matrixing means being adapted to combine the main signal component applied to its first input and the replica of the main signal component applied to its second input so as to obtain the output signal, second compression means having an input coupled to the output of the matrixing means and an output, the second compression means being adapted to carry out a data reduction step on the signal applied to its input in response to a second masking control signal and to supply a data reduced output signal to its output, second masking control signal generator means for generating the second masking control signal for the second compressing means and for generating a second instruction signal, the masking control signal generator means being adapted to derive the masking control signal from the main signal component applied to the first input of the matrixing means, the second instruction signal being generated for enabling an expansion on the data reduced output signal of the second compression means so as to obtain a replica of the output signal of the matrixing means, signal combination means for combining the output signals of the first and the second compression means as well as the first and second instruction signal so as to enable the transmission of those output signals.

In the application where a stereo signal should be transmitted as a monosignal for enabling reception by means of mono receivers, the matrixing means combine the first and second signal in an additive way.

The invention is based on a number of measures that have been taken. The first measure is that, instead of transmitting the difference signal L–R, either the left or the right hand signal component of the stereo signal is transmitted together with the sum signal M. Quantizing the M and A signals results, after dematrixing in the receiver, in contributions of the quantization noise of the L-component in the R-component and vice verse. Those contributions become audible upon reproduction. Transmitting either the L- or the R-component together with the M-component results, after dematrixing, in a situation where there is generally no contribution of the quantization noise belonging to the L-component to the quantization noise for the R-component. Therefore, generally no quantization noise will be come audible.

Further, a prequantization and a corresponding dequantization is carried out on the second signal before matrixing, and the replica of the second signal is applied to the matrixing means. The quantization noise belonging to the second signal is thus already present in the replica that is applied to the matrixing means. This enables a correct splitting up of the quantization noise belonging to the two signal components during dematrixing, so that each signal component affected with its own quantization noise.

Also, the masking control signal for the second compression means, which compresses the sum signal M, is not derived from the sum signal itself, as would normally be the case, but from the first main signal component. In this way, the quantization noise created by the second compression means is masked by a masking curve obtained from the first signal component. It should be noted that the first signal component is available after dequantization and dematrixing in a receiver, and with the above measure the quantization noise in the first signal component regenerated in the receiver is masked.

In the situation where a stereo signal is encoded and transmitted by the transmitter, there is the possibility of fixedly applying the left hand signal component to the first input terminal and the right hand signal component to the second input terminal. The masking model for the data reduction to be carried out on the sum signal M is now always determined by the left hand signal component. This however will not always lead to a maximum data reduction of the left and right hand signal components obtained, so as to enable transmission via the transmission medium. A further embodiment of the transmitter enables the possibility of exchanging the application of the left and right hand signal components to both input terminals. That means that, for time equivalent signal portions of the left and right hand signal components, in cases which applying the right hand signal component to the first input terminal would lead to a larger overall data reduction ratio than if the left hand signal component had been applied to the first input terminal, the application of both signals to both input terminals is exchanged.

A transmitter for transmitting a first and a second main signal component and at least one auxiliary signal component therefore comprises at least three input terminals for receiving the at least three signal components, first compression means having at least one input and at least one output, the at least one input being coupled to the at least third input terminal, the first compression means being adapted to carry out a data reduction step on the signal component applied to its at least one input in response to a masking control signal and to supply a compressed signal component to an output, first masking control signal generator means for generating the masking control signal for the first compression means and for generating a first instruction signal, the masking control signal generator means being adapted to derive the masking control signal and the first instruction signal from the signal component applied to the at least one input of the first compression means, expansion means having at least one input and at least one output, the at least one input being coupled to the first compression means, the expansion means being adapted to carry out a data expansion on the data information applied to its at least one input so as to obtain a replica of the signal component applied to the at least one input of the first compression means and to supply the replica to the said at least one output, matrixing means having a first, second and at least third input, the first and second input being coupled to the first and second input terminal respectively, and the at least third input being coupled to the at least one output of the expansion means, the matrixing means having a first and a second output for supplying a first and a second output signal, the matrixing means being adapted to combine the first main signal component and the at least one auxiliary component so as to obtain the first output signal, and being adapted to combine the second main signal component and the at least one auxiliary signal component so as to obtain the second output signal, second compression means having a first and second input coupled to the first and second output of the matrixing means respectively and a first and a second output, the compression means being adapted to carry out a data reduction step on the signals applied to its first and second inputs in response to masking control signals and to supply data reduced first and second output signals to the first and second output, second masking control signal generator means for generating the masking control signals for the second compression means and for generating second instruction signals, the masking control signal generator means being adapted to derive the masking control signals from the signal components applied to first and second inputs of the matrixing means, the second instruction signals being generated for enabling an expansion on the data reduced output signals of the second compression means so as to obtain replicas of the first and second output signals of the matrixing means, signal combination means for combining the output signals of the first and the second compression means as well as the first and second instruction signals so as to enable the transmission of those output signals.

In this embodiment, the transmitter also carries out a prequantization and a corresponding dequantization on the signal applied to the third input terminal, before matrixing.

It should be noted here, that in one embodiment of the transmitter, the first and second main signal component (such as the left and right hand signal component of the stereo signal) are fixedly applied to the first and second input terminal respectively, and that the first auxiliary signal (such as the centre signal C given above) is applied to the third input terminal. This means that the masking model for the data reduction to be carried out in the second compression means on the first and second output signals of the matrixing means is now always determined by the first and second main signal components. For the same reason as given above, this will not always lead to a maximum data reduction on all the signal components obtained, so as to enable transmission via the transmission medium. A further embodiment of the transmitter enables the possibility of exchanging the application of the at least three signal components to the at least three input terminals. That means that it is determined, for time equivalent signal portions of the at least three signal components, which combination of two of such three signals, when applied to the first and second input terminal, results in the maximum data reduction.

It might even be possible to switch over to the original transmission mode, where M and A will be transmitted, namely for those time equivalent signal portions of the L- and R-signal component that lead to the maximum available data reduction.

If the transmitter is capable of exchanging the input signals before encoding, the corresponding receiver should be capable of rearranging the signals in their original order upon decoding. For that purpose the receiver comprises demultiplexer means for retrieving first and second instruction signals and compressed first and second signals from an information signal received from the transmission medium, and for supplying said signals to expansion means having at least two outputs, the expansion means being adapted to carry out a data expansion on the first compressed signal in response to the first instruction signal so as to obtain a replica of the original uncompressed first signal and to supply the replica to a first one of said at least two outputs, to carry out a data expansion on the second compressed signal in response to the second instruction signal so as to obtain a replica of the original uncompressed second signal and to supply the replica to the other of said at least two outputs, dematrixing means having at least a first and second input coupled to the at least first and second output respectively of said expansion means and having at least one output, the dematrixing means being adapted to combine the signals applied to its inputs so as to obtain an output signal for applying to said at least one output, at least two output terminals for supplying the at least two main signal components, is characterized in that the demultiplexer means is further adapted to retrieve at least the first and second control signals from the information signal received from the transmission medium, the receiver further comprising receiving means for receiving the output signal present at the at least one output of the dematrixing means, and for receiving the output signal present at the first output of the expansion means and for applying the two output signals to the first and second output terminal respectively in response to the first control signal, and for applying the two output signals to the second and first output terminal respectively in response to the second control signal.

In the situation where the transmitter capable of exchanging the input signals, is in the form of an arrangement for recording the signals on a record carrier, a record carrier thus obtained is characterized in that it comprises the output signal of the signal combination means recorded in the track, the said output signal comprising the at least first and second control signal.

BRIEF DESCRIPTION OF THE DRAWINGS

The invention will be further described with reference to the accompanying drawings, in which.

DESCRIPTION OF THE EMBODIMENTS

Figure 1A:
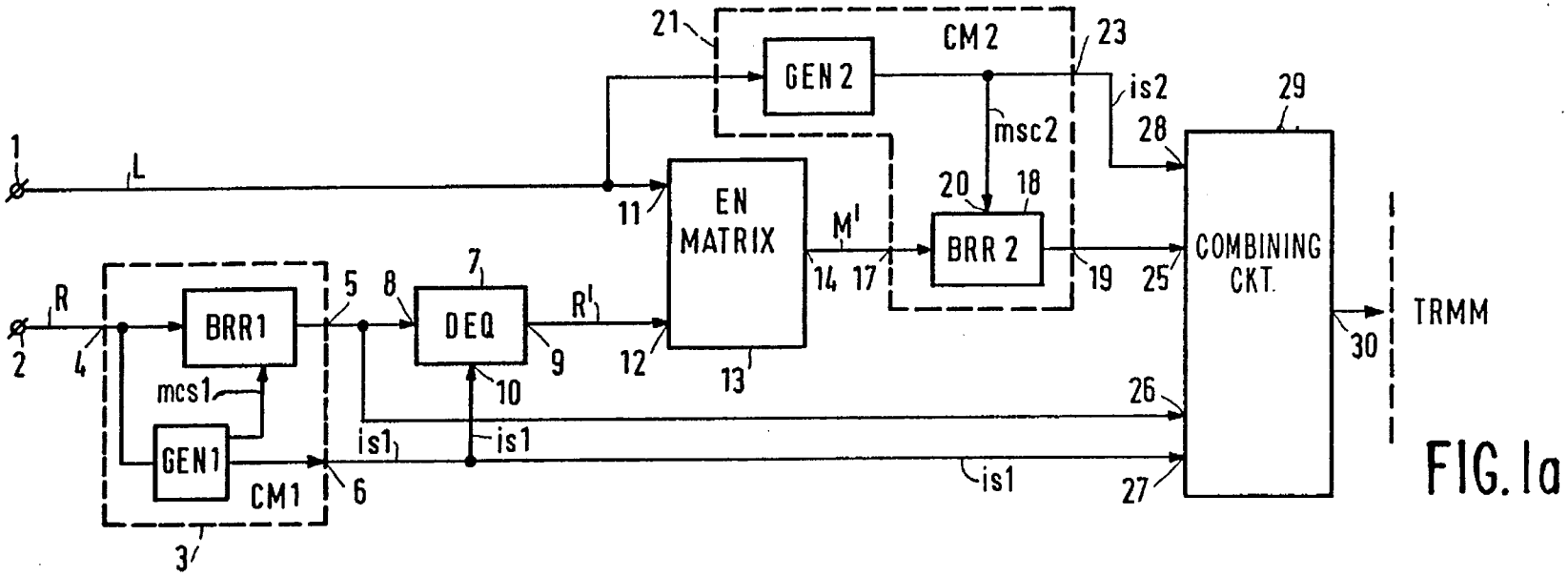
FIG. 1*a* shows a first embodiment of the transmitter and FIG. 1*b* shows a first embodiment of a corresponding receiver.

FIG. 1*a* shows a transmitter for transmitting a first and a second main signal component, more specifically the left (L) and right (R) hand signal component of a stereo audio signal, via a transmission medium TRMM. A digitized version of the left signal component L is applied to a first input terminal 1 and a digitized version of the right signal component is applied to a second input terminal 2. The transmitter comprises first compression means 3, denoted by CM1, in which a bit rate reduction, namely in the element denoted by BRR1, is carried out on the signal applied to its input 4 in response to a first masking control signal mcs1 which is applied to a control input of the bit rate reducer BRR1. A possible embodiment of the compression means 3 has been extensively described in the above mentioned published European patent applications 457,390A1 (PHN 13.328) and 457,391A1 (PHN 13.329). This embodiment comprises a subband coder for subband splitting the input signal into a number of M subband signals occurring in consecutive subbands. For time equivalent signal blocks of q samples in each of the subbands, each sample being for example 16 bits a bit allocation information $n_m$ is derived from the signal contents of the subband signals $SB_m$ in the various subbands, where m runs from 1 to M. The bit allocation information constitutes the masking control signal, and is derived by the block denoted by GEN1. A quantization is then carried out (in the block BRR1) on the q 16-bit samples in each in the time equivalent signal blocks of the subband signals in the M subbands in response to the bit allocation information $n_m$, such that the q quantized samples in a signal block of the subband signal $SB_m$ are now represented by $n_m$ bits. When the value of $n_m$, averaged over the corresponding M values for $n_m$ is, as an example, 4, this means that data reduction by a factor of 4 (16/4) has been obtained. The bit rate reduced signal (that is: the quantized subband signals) is (are) applied the output 5 of the compression means 3. Moreover, the bit allocation information $n_1$ to $n_M$, is also supplied to an output 6. The bit rate reduction carried out is based on the effect of masking, whereby an audio frequency component having a certain frequency and a certain amplitude has a masking effect of a certain level on neighboring frequency components. Neighboring frequency components having an amplitude below the masking level are therefore inaudible and need not be taken into account. The masking level in the various subbands relate to the bit allocation information, that is the values $n_1$ to $n_M$. The bit allocation information should thus be considered as the first masking control signal mcs1, as already indicated above, which is generated by the masking control signal generator GEN1.

The compressed data supplied by the compression means 3 is applied to an input 8 of expansion means 7, denoted DEQ. Further, the masking control signal mcs1 is applied together with scale factor information as the first instruction signal is1 to a control input 10 of the expansion means 7. In response to the instruction signal is1, the expansion means 7 realizes a dequantization of the quantized signals applied to the input 8, so as to generate a replica R' of the original right hand signal component R. This means that for time equivalent signal blocks in the M subband signal, the samples are retrieved from the compressed data received of the input 8, the q $n_m$-bit samples in the subbandsignal $SB_m$ being reconverted to 16-bit samples. The subband signals so obtained are combined in a subband combiner so as to obtain a replica of the original wideband right hand signal component.

Subband splitters and corresponding subband combiners are extensively described in the prior art, see eg. published European patent application 400,755 (PHQ 89.018).

It should be noted that the input of the expansion means 7 need not necessarily be coupled to the output 5 of the compression means 3, but can alternatively be coupled to an internal terminal in the bitrate reducer BRR1. This is explained as follows. Bitrate reduction of the input signal in the bitrate reducer BRR1 means that the following steps are to be carried out on the 16-bit (as an example) samples in a signal block of the subband signal in subband m. First the q samples in the signal block are normalized in a normalization step, using a scale factor. Then a quantization step follows in which the 16-bit samples are converted to $n_m$-bit numbers. Supplying the $n_m$-bit numbers to the expander 7 requires that both the scale factors and the bit allocation information (the $n_m$-values) be supplied to the expander. It is alternatively possible, however, to supply 'rounded' samples to the expander 7, instead of their identifying $n_m$-bit numbers. These 'rounded' samples are still represented in the full 16-bit precision. In this situation, the input of the expander 7 would be coupled to an internal terminal within bitrate reducer BRR1 at which the 'rounded' samples are available. Further, only the scale factors would need to be supplied to the expander 7, in order for it to produce a replica of the input signal supplied to the bitrate reducer BRR1.

The input terminal 1 is coupled to a first input 11 of matrixing means 13. The output 9 of the expansion means 7 is coupled to a second input 12 of the matrixing means 13. The matrixing means 13 combine the signals L and R' applied to the inputs 11 and 12 respectively so as to obtain a sum signal M' which is applied to an output 14. The sum signal M' satisfies the following equation: M'=a(L+R'). The output 14 of the matrixing means 13 is coupled to an input 17 of second compression means 21, denoted CM2. The second compression means are adapted to carry out a bit rate reduction in the element 18, denoted BRR2, under the influence of a second masking control signal mcs2 applied to a control input 20. The compression means 21 comprises second masking control signal generator means GEN2 for generating a second masking control signal mcs2, which is applied to the control input 20 of the bit rate reduction element BRR2. This masking control signal can again be in the form of bit allocation information values $n_1$ to $n_M$, as explained above. The compression carried out on the sum signal M' can be identical to the way in which the bit rate reduction in the compression means CM1 is carried out. The resulting data compressed sum signal is supplied at an output 19. Moreover, a second instruction signal is2, which includes the second masking control signal mcs2, and also scale factor information, is produced at an output 23. It should be noted that the scale factor information is preferably derived from the sum signal M', e.g. in the bitrate reducer BRR2.

The compressed sum signal and the compressed right hand signal component are applied to inputs 25 and 26 respectively of signal combination means 29. The first and second instruction signals is1 and is2 are applied to inputs 27 and 28 respectively of the combination means 29. The combination means 29 combine the compressed signals and the instruction signals (bit allocation information) so as to obtain a serial datastream that can be applied via an output 30 to a transmission medium.

Published European patent application 402,973 (PHN 13.241) extensively describes how compressed signals and bit allocation information can be combined so as to obtain a serial data stream of information. Another way of combining both signal components is by applying hidden channel techniques. Reference is made in this respect to the previously mentioned J. A. E. S. publication.

Figure 1B:
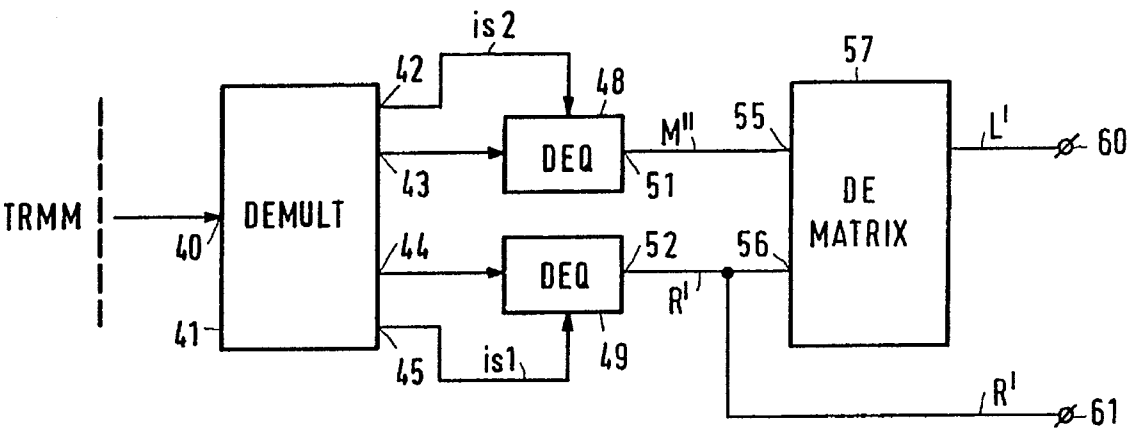

FIG. 1*b* shows a receiver for receiving and decoding the compressed signals transmitted via the transmission medium TRMM. The serial datastream is applied to an input 40 of a demultiplexer 40, which splits the information in the serial datastream into the original quantized samples of the sum signal, which samples are applied to an output 43, the original quantized samples of the right hand signal component, which samples are applied to an output 44, the first instruction signal is1, which is applied to an output 45 and the second instruction signal is2, which is applied to an output 42. The outputs 43 and 44 are coupled to signal inputs of expansion means (dequantizers DEQ) 48 and 49 respectively. The outputs 42 and 45 are coupled to control signal inputs of the quantizers 48 and 49 respectively, so as to enable the instruction signals to be applied to the dequantizers. The dequantizers 48 and 49 function in the same way as the dequantizer 7 in the transmitter of FIG. 1*a*. The dequantizer 48 thus generates a replica M" of the sumsignal M', which is supplied to an output 51. The dequantizer 49 thus generates the replica R' of the right hand signal component R, which is supplied to an output 51. The outputs 51 and 52 are coupled to inputs 55 and 56 respectively of a dematrixing means 57. The dematrixing means 57 derives a replica L' of the original left hand signal component from the signals applied to its inputs 55 and 56. The signal components L' and R' obtained are applied to output terminals 60 and 61 respectively of the receiver.

It should be noted that monoreceivers comprise the dequantizer 48 and are further capable of retrieving the monosignal component and the $is_2$ information from the serial datastream received from the transmission medium, so as to obtain a replica of the monosignal after dequantization.

Figure 2A:
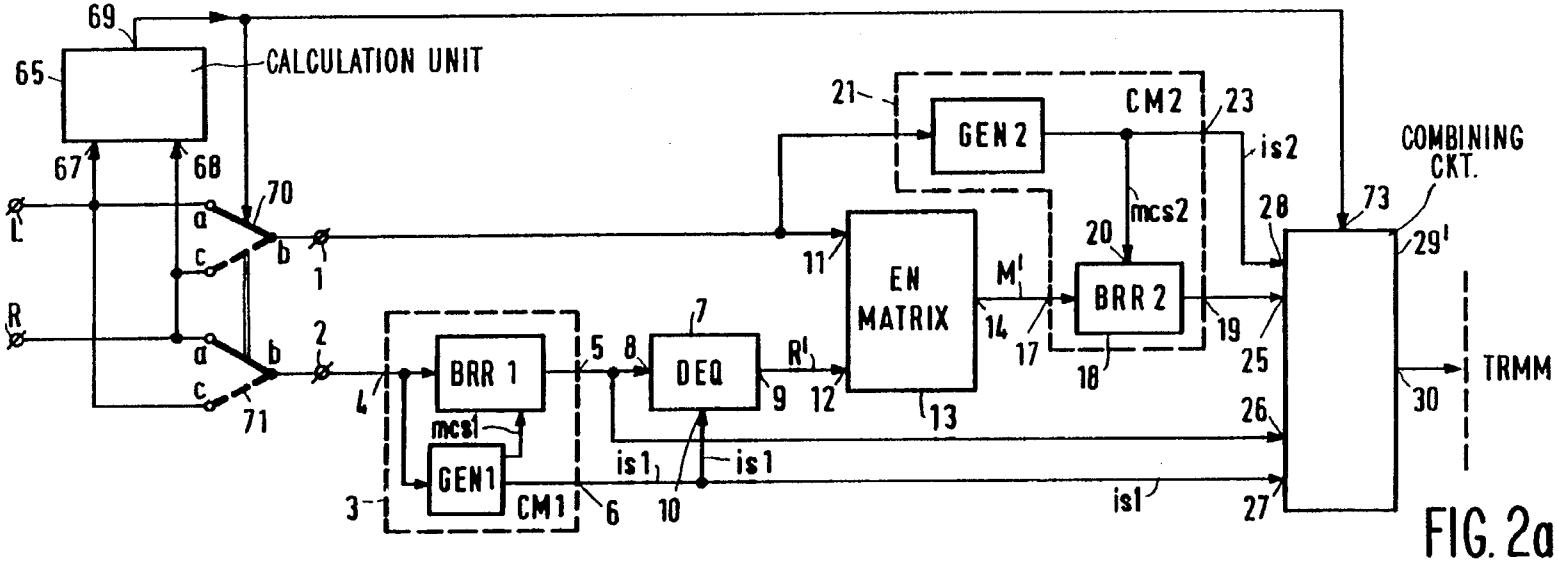
FIG. 2*a* shows a second embodiment of the transmitter and FIG. 2*b* shows a second embodiment of a corresponding receiver.

In a further extension of the embodiment of the transmitter of FIG. 1*a*, the transmitter of FIG. 2*a* further comprises calculation means 65 for calculating a first data reduction ratio relating to the amount of data reduction realized by the first and second compression means together, for the case that the left hand signal component would have been applied to the first input terminal 1, and for calculating a second data reduction ratio for the case that the right hand signal component would have been applied to the first input terminal 2. The bit allocation information $n_1$ to $n_M$, derived in the two compression means and discussed previously, is a measure for such data reduction ratio, in that the lower the values for $n_1$ to $n_M$, the higher is the data reduction ratio. The calculation means 65 is thereto capable of determining the bitallocation information $n_{11}$ to $n_{M1}$ for the left hand signal component L and capable of determining the bitallocation information $n_{1r}$ to $n_{Mr}$ for the right hand signal component R. To that purpose, both signal components are applied to inputs 67 and 68 respectively of the means 65. This calculation of the two sets of values $n_{11}$ to $n_{M1}$ and $n_{1r}$ to $n_{Mr}$ is thus carried out each time for time equivalent signal blocks of q samples of the subband signals of both signal components L and R.

Two data reduction ratios (or values) are determined. One for the case that the first compression means CM1 compress the second main signal component and the second compression means CM2 compress the sum signal M, where the masking curve for the second compression means is derived from the first main signal component, and the other for the case that the first compression means CM1 compress the first main signal component and the second compression means CM2 compress the sum signal M, where the masking curve for the second compression means is derived from the second main signal component.

If the first data reduction ratio appears to be the higher (lower) one, a first (second) control signal is applied to an output 69. A first control signal generated by the means 65 indicates that the left hand signal component realizes the largest masking power, so that the two compression means CM1 and CM2 realize the largest amount of data compression. A second control signal generated by the means 65 indicates that the right hand signal component realizes the largest masking power, so that the two compression means CM1 and CM2 realize the largest amount of data compression. As a result, always the maximum channel capacity is available for the signal applied to the input terminal 2.

The transmitter of FIG. 2*a* further comprises receiving means in the form of first and second controllable switches 70 and 71. The left hand signal component is applied to the a-terminal of the switch 70 and to the c-terminal of the switch 71. The right hand signal component is applied to the a-terminal of the switch 71 and to the c-terminal of the switch 70. The switches connect their a- and b-terminals in response to the first control signal applied to the switches. The switches connect their c- and b-terminals in response to the second control signal. In this way, either the left or the right hand signal component is applied to the input terminal 1, and the right or left hand signal component is applied to terminal 2.

The first or second control signal supplied by the means 65 is further applied to an input 73 of the combination means 29', which is also adapted to supply the first or second control signal to its output 30, for transmission via the transmission medium TRMM.

It should be noted that in order to generate the first or second control signal, the calculation means 65 have calculated two sets of bit allocation information, namely the values $n_{11}$ to $n_{M1}$ and the values $n_{1r}$ and $n_{Mr}$ values. One of these sets of values form the second masking control signal mcs2, used in the second compression means 21, dependent on whether the first or the second control signal is applied by the means 65. As a result of the first control signal, the set of values $n_{11}$ to $n_{M1}$ could have been applied directly to the bit rate reducer BRR2 as the masking control signal mcs2. As a result of the second control signal, the set of values $n_{1r}$ to $n_{Mr}$ could have been applied directly to the bit rate reducer BRR2 as the masking control signal mcs2. This signifies that the generator GEN2 may be dispensed with.

Figure 2B:
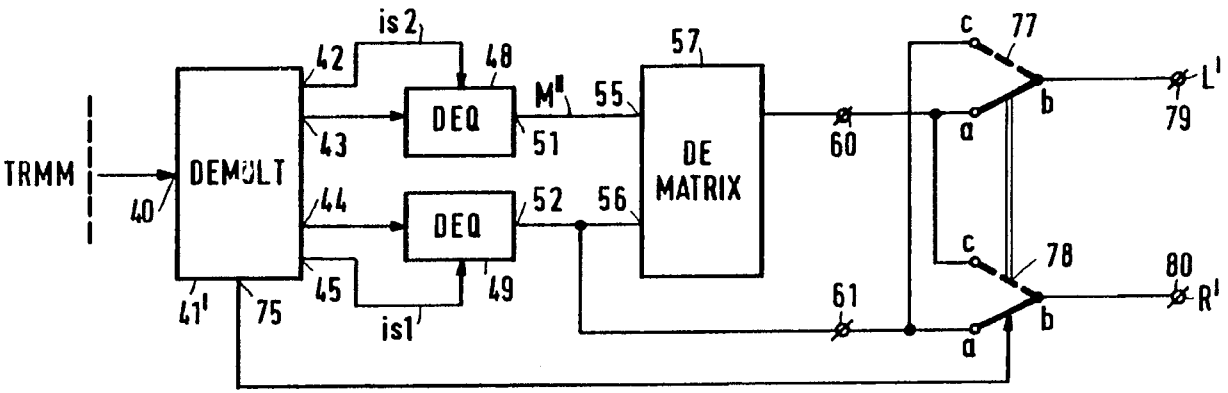

The receiver of FIG. 2*b* which is capable of receiving the data stream supplied by the transmitter of FIG. 2*a*, now comprises a demultiplexer 41', which is moreover capable of retrieving the first or second control signal from the datastream received, and to supply the first or second control signal to an output 75. The control signal present at the output 75 is applied to controllable switches 77 and 78. The switches connect their a- and b-terminals in response to the first control signal applied to the switches. The switches connect their c- and b-terminals in response to the second control signal. In this way, care has been taken that the left and the right hand signal components L' and R' are applied to the terminals 79 and 80 respectively.

Figure 3A:
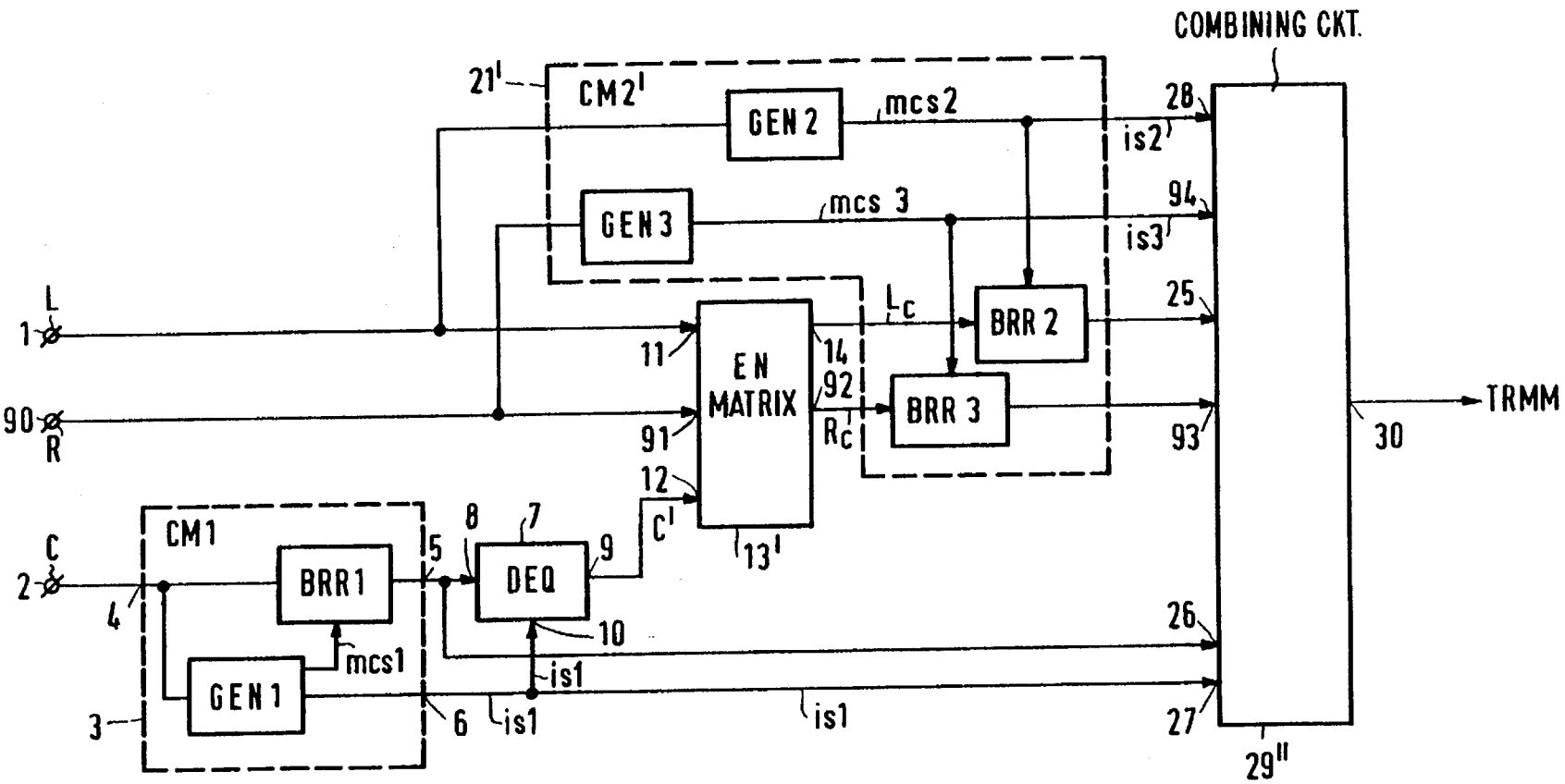
FIG. 3*a* shows a third embodiment of the transmitter and FIG. 3*b* shows a third embodiment of a corresponding receiver.
Figure 3B:
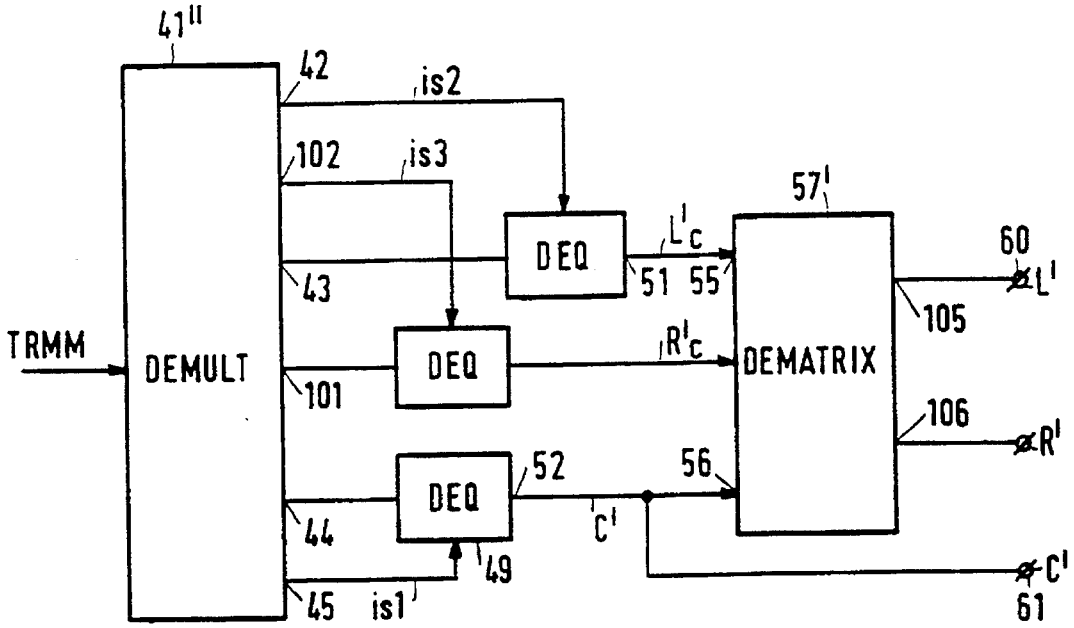

FIG. 3 shows an other embodiment of a transmitter in FIG. 3*a*, and the corresponding receiver in FIG. 3*b*. The transmitter is meant to transmit a first and a second main signal component, such as the left and right hand signal component L and R of a stereo audio signal, and an auxiliary signal C, which is a central audio signal. The transmitter of FIG. 3*a* is largely the same as the transmitter of FIG. 1*a*. An additional input terminal 90 is present. The right hand signal component R is now applied to the terminal 90 and the central signal C is applied to the terminal 2. The terminal 90 is coupled to an additional input 91 of the matrixing means 13'. The signal processing carded out on the C-signal by means of the compression means CM1 and the dequantizer 7 is fully identical to the signal processing carried out on the R-signal in FIG. 1*a*. This means that at the output 9 of the dequantizer 7 a replica C' of the original C-signal is available. What has been said above in relation to the cooperation and the interconnection between the bitrate reducer BRR1 and the expander 7 of FIG. 1*a* is equally valid for the cooperation and the interconnection between the bitrate reducer BRR1 and the expander 7 in FIG. 3*a*.

The matrixing means 13' generates first and second output signals $L_c$ and $R_c$ respectively at outputs 14 and 92 respectively, which satisfy the following equations:

$$L_c = L + a.C$$

$$R_c = R + a.C$$

Both signals $L_c$ and $R_c$ are applied to second compression means CM2', in which a data reduction step is carried out on both signals in response to masking control signals mcs2 and mcs3 obtained from the original signals applied to the inputs 11 and 91 of the matrixing means 13'. In the present embodiment of the compression means CM2', the compression means comprises the generator GEN2, already explained with reference to FIG. 1*a*, which derives the masking control signal from the left hand signal component L, and a generator GEN3, which functions in the same way as the generator GEN2, and which derives the masking control signal mcs3. Further, in addition to the bitrate reducer element BRR2, which functions in the same way as the element BRR2 in FIG. 1*a*, a bitrate reducer element BBR3 is present, which functions in the same way as the bitrate reducer BBR2, and which derives a data compressed output signal from the signal $R_c$, which data compressed signal is applied to its output. The three data compressed signals and the corresponding instructions signals is1, is2 and is3, which comprise the masking control signals mcs2 and mcs3 respectively, and the scale factors derived from the signals $L_c$ and $R_c$ respectively, are applied to the signal combination means 29" which combines all the signals so as to enable transmission of the signals via the transmission medium TRMM.

It should be noted that the derivation of the two masking control signals mcs2 and mcs3 is realized separately in the two elements GEN2 and GEN3. It should however be noted that both masking control signals can be derived in a combined procedure out of the signals L and R. Reference is made in this respect to published European patent application 457,390A1 (PHN 13.328).

It should further be noted that, in order to further reduce the bitrate in the second compression means CM2, it is possible to apply a stereo-intensity mode coding on time equivalent signal blocks of the corresponding subband signals in the first and second output signals of the matrixing means 13'. A stereo-intensity mode coding of a stereo signal is extensively described in European patent application no. 402,973A1 (PHN 13.241) and European patent application no. 497,413A1 (PHN 13.581).

The receiver of FIG. 3*b* includes demultiplexing means 41" which are, in addition to the demultiplexing means 41 of FIG. 1*b* capable of retrieving the data compressed signal $R_c$ and the instruction signal is3 from the received datastream, and applies the compressed signal to an output 101 and the instruction signal is3 to an output 102. Dequantization is carried out on the three compressed signals in the normal way, which results in replicas $L_c'$, $R_c'$ and C' of the output signals $L_c$ and $R_c$ of the matrixing means 13' and the C-signal respectively. The three signals are applied to dematrixing means 57', in which replicas of the original left and right hand signal components are derived and supplied to outputs 105 and 106 respectively.

Figure 4A:
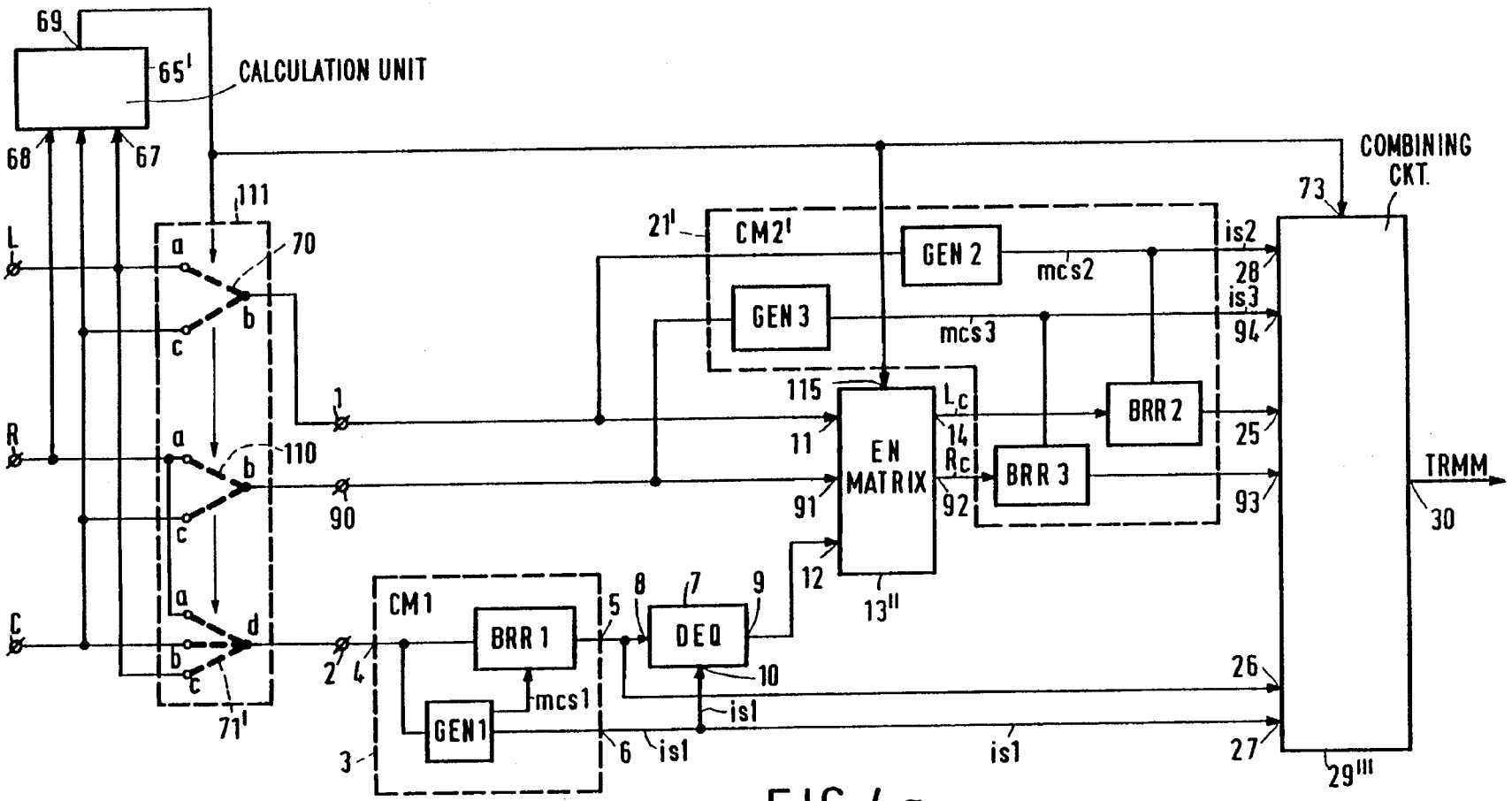
FIG. 4*a* shows a fourth embodiment of the transmitter and FIG. 4*b* shows a fourth embodiment of a corresponding receiver.

Instead of fixedly applying the signals L, R and C to the terminals 1, 90 and 2 respectively, it is in the same way as described with reference to FIG. 2, possible to exchange the signals. This embodiment is shown in FIG. 4*a*. It should be noted that exchanging the signals means that:

a) the L signal is applied to the terminal 1 and that the R-signal is applied to the terminal 90, in which case the C-signal is applied to terminal 2.

b) the L-signal is applied to the terminal 1 and that the C-signal is applied to the terminal 90, in which case the R-signal is applied to terminal 2.

c) the C-signal is applied to the terminal 1 and that the R-signal is applied to the terminal 90, in which case the L-signal is applied to terminal 2.

It should however be noted that in all cases the matrixing means generate the same output signals $L_c$ and $R_c$, irrespective of which signals are applied to its inputs 11, 91 and 12.

The transmitter of FIG. 4*a* includes calculation means 65'. The calculation means 65' calculate three data reduction ratios. A first data reduction ratio which is a measure for the amount of data reduction realized by the first and second compression means CM1 and CM2' together, for the case that the first main signal component L would have been applied to the first input terminal 1, and the R signal component would have been applied to the input terminal 90. In that case, the masking control signals mcs2 and mcs3 are derived from the signals L and R. The second data reduction ratio relates to the amount of data reduction realized by the compression means CM1 and CM2' together, for the case that the L signal component would have been applied to the first input terminal 1, and the C signal component would have been applied to the input terminal 90. In that case, the masking control signals mcs2 and mcs3 are derived from the signals L and C. The third data reduction ratio relates to the amount of data reduction that would have been obtained by the compression means CM1 and CM2' together, for the case that the C signal component would have been applied to the input terminal 1 and the R signal component would have been applied to the input terminal 90. In that case, the masking control signals mcs2 and mcs3 are derived from the signals C and R. The calculation means 65' generate a first control signal if the first data reduction ratio is larger than the other two, a second control signal if the second data reduction ratio is larger than the other two, or a third control signal if the third data reduction ratio is larger than the other two, and supplies the control signal to its output 69. The control signal is applied to switching means 111 comprising three switches 70, 71' and 110. In response to the first control signal, the switch 70 is switched in its position a–b, the switch 110 is switched in its position a–b and the switch 71' is switched in its position b–d, so that the L-, R- and C-signals are applied to the terminals 1, 90 and 2 respectively, as in FIG. 3*a*. In response to the second control signal, the switch 70 is switched in its position a–b, the switch 110 is switched in its position c–b and the switch 71' is switched in its position a–d, so that the L-, C- and R-signals are applied to the terminals 1, 90 and 2 respectively. In response to the third control signal, the switch 70 switched in its position c–b, the switch 110 is switched in its position a–b and the switch 71' is switched in its position c–d, so that the C-, R- and L-signals are applied to the terminals 1, 90 and 2 respectively.

The output 69 of the calculation means is further coupled to a control signal input 115 of the matrixing means 13". In response to the first, second or third control signal applied to the input 115, the matrixing means 13" generate the first and second output signals $L_c$ and $R_c$ irrespective of to which of the input terminals 1, 90 and 2 the three signals L, R and C are applied. The control signal generated by the calculation means 65' is also applied to the input 73 of the combination means 29'", so as to enable the transmission of the control signal via the transmission medium.

Figure 4B:
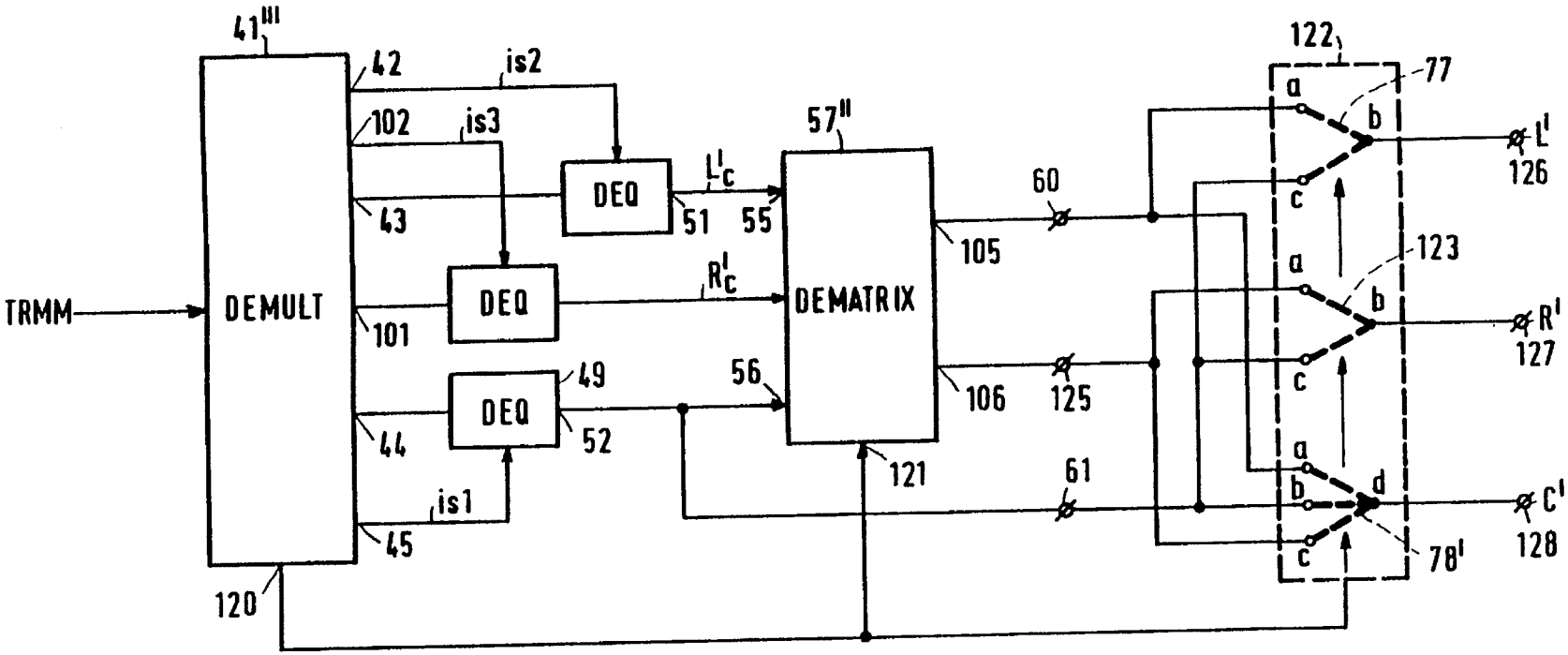

FIG. 4*b* shows an embodiment of the receiver for receiving the signals transmitted by the transmitter of FIG. 4*a*. The receiver of FIG. 4*b* shows much resemblance with the receiver of FIG. 3*b*. The demultiplexer means 41'" has an additional output 120 for supplying the first, second or third control signal generated by the calculation means 65' of the transmitter of FIG. 4*a*. The dematrixing means 57" has an additional control signal input 121 which is coupled to the output 120 of the demultiplexer means 41'". If the control signal applied to the control signal input 121 is the first control signal, this means that the signal applied to the input 56 of the matrixing means 57'" is the replica of the C-signal. In that case, the receiver functions identical to the receiver of FIG. 3*b*, so that replicas of the L- and R-signals are applied to the terminals 60 and 125 respectively. If the control signal applied to the control signal input 121 is the second control signal, this means that the signal applied to the input 56 of the matrixing means 57'" is the replica of the R-signal. In that case, the dematrixing means 57" functions such that replicas of the L- and C-signals are applied to the terminals 60 and 125 respectively. If the control signal applied to the control signal input 121 is the third control signal, this means that the signal applied to the input 56 of the matrixing means 57'" is the replica of the L-signal. In that case, the dematrixing means 57" functions such that replicas of the C- and R-signals are applied to the terminals 60 and 125 respectively.

The receiver further comprises controllable switching means 122 comprising switches 77, 123 and 78'. In response to the first control signal applied to the switching means 122, the switch 77 is switched in the position a–b, the switch 123 is switched in the position a–b and the switch 78' is switched in the position b–d, so that the replicas L', R' and C' are applied to the terminals 126, 127 and 128 respectively. In response to the second control signal applied to the switching means 122, the switch 77 is switched in the position a–b, the switch 123 is switched in the position c–b and the switch 78' is switched in the position c–d, so that the replicas L', R' and C' are again applied to the terminals 126, 127 and 128 respectively. In response to the third control signal applied to the switching means 122, the switch 77 is switched in the position c–b, the switch 123 is switched in the position a–b and the switch 78' is switched in the position a–d, so that the replicas L', R' and C' are again applied to the terminals 126, 127 and 128 respectively.

It will be clear that the dematrixing means 57" and the switching means 122 can be combined into one combined dematrixing means having three outputs, which supplies the first and second main signal components to its first and second outputs and the auxiliary signal to its third output in response to the control signals applied to the combined dematrixing means.

Figure 5:
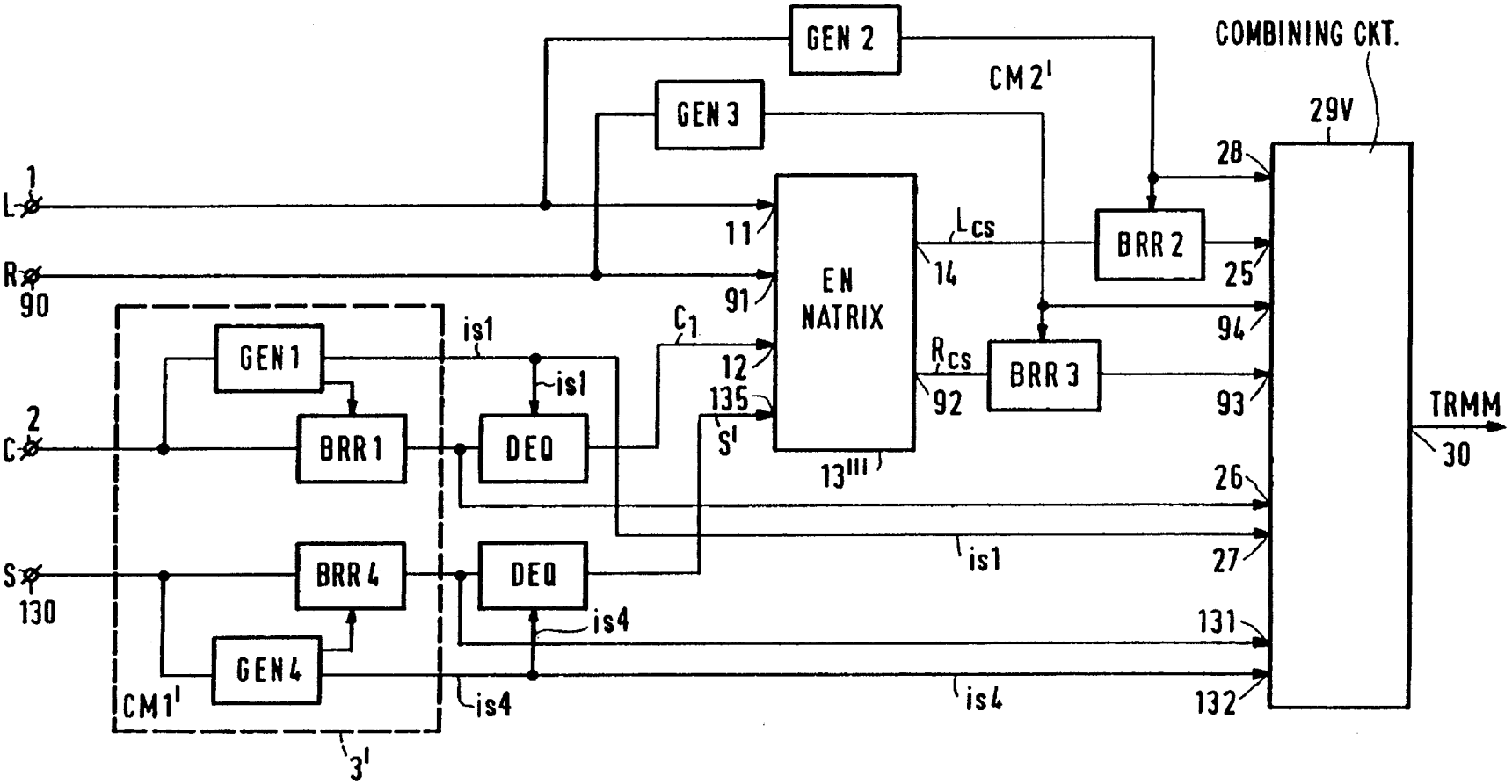
FIG. 5 shows a fifth embodiment of the transmitter.

FIG. 5 shows an embodiment of a transmitter for transmitting at least four signal components: the already mentioned L-, R- and C-signal component and an additional S-signal component. The S-signal component can be considered as a surround signal component for two loudspeakers positioned on the left and right hand side behind the listener. The S-signal component can be one single signal, in which case the S-signal is applied to both loudspeakers, or two signals $S_1$ and $S_r$, for the left and right loudspeaker behind the listener respectively. The transmitter of FIG. 5 shows much resemblance with the transmitter of FIG. 3*a*. The transmitter has at least a fourth input terminal 130 for receiving the S-signal component. The signal processing carried out on the S-signal component is identical to the signal processing carried out on the C-signal component: a data compression is carried out in the first compression means CM1' and the compressed S-signal is applied to an input 131 of the signal combination means 29v. Also an instruction signal is4, necessary for a corresponding expansion to be carried out in the receiver on the compressed S-signal, is applied to an input 132 of the combination means 29v. The compressed S-signal is expanded in a dequantizer so as to obtain a replica S' of the S-signal, which replica is applied to an input 135 of matrixing means 13'''.

The matrixing means 13''' generates first and second output signals $L_{cs}$ and $R_{cs}$ respectively at outputs 14 and 92 respectively, which satisfy the following equations:

$$L_{cs}=L+a.C+b.S$$

$$R_{cs}=R+a.C+b.S$$

Both signals $L_{cs}$ and $R_{cs}$ are applied to second compression means CM2'.

For the situation that five signals are applied to the transmitter, the matrixing means generates first and second output signals $L_{cs}'$ and $R_{cs}'$ which satisfy the following equations:

$$L_{cs}=L+a.C+b.S_1+c.S_r$$

$$R_{cs}=R+a.C+c.S_1+b.S_r$$

From a further description of the receiver for receiving and decoding the signals transmitted by the transmitter of FIG. 5 is refrained as, with the information given above, such receiver is a straightforward further development of the receivers discussed earlier. The skilled man will be able to develop an embodiment of such receiver, using his skill and without the need of any inventive activity.

Also, from a further description of a transmitter which is capable of exchanging the input signals will be refrained as, with the information given above, such transmitter is a straightforward further development of the transmitters discussed earlier. The skilled man will be able to develop an embodiment of such transmitter, using his skill and without the need of any inventive activity.

Further, no description of a receiver which is capable of receiving such exchanged signals will be given, for the same reasons as given above.

It should further be noted that extensions to more than a four signal transmission is possible. In a five signal transmission, the fifth signal can be an effect signal, which signal is well known in movie reproduction.

Figure 6:
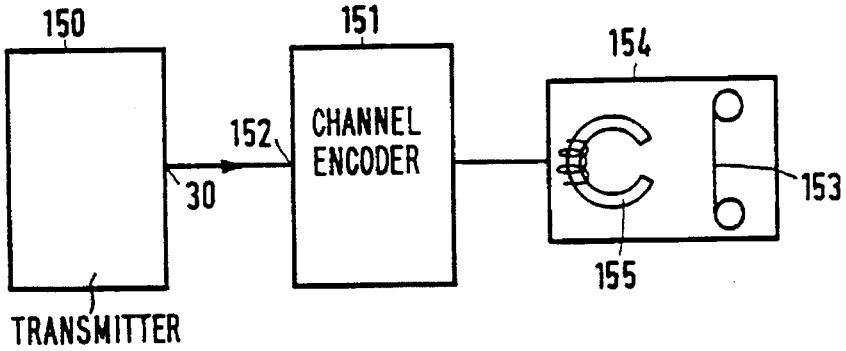
FIG. 6 shows a transmitter in the form of a recording arrangement.

The transmitter can be used in an arrangement for recording the signal supplied by the signal combination means 29, 29', 29", 29''' and 29v on a record carrier. FIG. 6 schematically shows such a recording arrangement. The block denoted by 150 is one of the transmitters described previously. The block denoted by 151 is a channel encoder, in which the signal applied to its input 152 is encoded in, as an example a Reed-Solomon encoder, and an interleaver, so as to enable an error correction to be carried out in the receiver. Further, again as an example an 8-to-10 modulation well known in the art, is carried out. The signal thus obtained is recorded in a track on a record carrier 153, such as a magnetic or optical record carrier, by means of writing means 154, such as a magnetic or optical head 155.

We claim:

1. A transmitter for transmitting a first and a second main signal component via a transmission medium, both of said main signal components being in digital form; said transmitter comprising:

a first and a second input terminal for respectively receiving the first and second main signal components;

first data compression means having an input and an output, the input being coupled to one of said input terminals to receive one of the first and second main signal components, said first data compression means being adapted to carry out a data compression of said one main signal component in response to a first masking control signal and to produce the resulting compressed one main signal component at its output;

first masking control signal generator means for generating said first masking control signal for the first data compression means and for further generating a first data expansion instruction signal applicable to said compressed one main signal component, both generated signals being generated from said one main signal component at the input of the first data compression means;

data expansion means having an input and an output, the input being coupled to the first data compression means to receive data therefrom, said data expansion means being adapted to carry out a data expansion of the data received from the first data compression means so as to derive at said output a replica of said one main signal component;

matrixing means having a first input coupled to the other of said input terminals to receive the other of said first and second main signal components, and a second input coupled to the output of said data expansion means to receive the replica of said one main signal component, the matrixing means being adapted to combine the signals received at its first and second inputs and produce a resulting combined signal at an output thereof;

second data compression means having an input and an output, the input being coupled to the output of said matrixing means to receive said combined signal, the second compression means being adapted to carry out a data compression of said combined signal in response to a second masking control signal and to produce the resulting compressed combined signal at its output;

second masking control signal generator means for generating said second masking control signal for the second data compression means and for further generating a second data expansion instruction signal, both generated signals from said second masking control signal generator means being generated from said other main signal component at the first input of said matrixing means, the second data expansion instruction signal being applicable to said compressed combined signal produced at the output of said second data compression means; and means for combining the output signals of the first and second data compression means and said first and second data expansion instruction signals so as to form a composite signal for transmission by said transmitter.

2. A transmitter as claimed in claim 1, characterized in that it further comprises:

calculating means coupled to the first and second input terminals for deriving from the first and second main signal components a first data reduction ratio corresponding to the data compression effected by the first and second data compression means together, when said first main signal component constitutes said one main signal component and said second main signal component constitutes said other main signal component, and a second data reduction ratio corresponding to the data compression effected by the first and second data compression together, when said second main signal component constitutes said one main signal component and said first main signal component constitutes said other main signal component;

said calculating means comprising means for generating a first control signal when the first data reduction ratio exceeds the second data reduction ratio, and for generating a second control signal when the second data reduction ratio exceeds the first data reduction ratio, the first and second control signals being supplied to said combining means for inclusion in said composite signal for transmission; and switching means coupled to the first and second input terminals to receive the first and second main signal components and controlled by the first and second control signals from said calculating means to select which of the first and second main signal components to use as said one main signal component which is applied to the input of the first data compression means, and which of the first and second main signal components to use as the other main signal component which is applied to the first input of said matrixing means; said first control signal causing selection of the first main signal component for use as said one main signal component, and said second control signal causing selection of the second main signal component for use as said one main signal component.

3. A transmitter as claimed in claim 2, characterized in that signal transmission is performed thereby by recording the composite output signal of the signal combining means on a record carrier.

4. A record carrier which has recorded thereon a composite signal produced by the signal combination means of a transmitter as claimed in claim 3, said composite signal comprising the control signals produced by the calculating means of said transmitter.

5. A transmitter as claimed in claim 1, wherein the input of said first data compression means is continuously coupled to the first input terminal to receive the first main signal component, and the input of said matrixing means is continuously coupled to the second input terminal to receive the second main signal component.

6. A transmitter for transmitting two main signal components and at least one auxiliary signal component via a transmission medium, all of said signal components being in digital form; the transmitter comprising:

a first input terminal for receiving a first of said signal components, a second input terminal for receiving a second of said signal components, and at least a third input terminal for receiving at least a third of said signal components;

first data compression means having an input coupled to said first input terminal to receive therefrom said first signal component, and being adapted to carry out a data compression thereof in response to a first masking control signal and to supply the resulting compressed first signal component at an output of said first data compression means;

first masking control signal generator means for generating said first masking control signal and for further generating a first data expansion signal, both of said generated signals being derived from said first signal component at said first input terminal;

data expansion means having an input coupled to said first data compression means and adapted to carry out a data expansion of data received therefrom so as to produce a replica of said first signal component from said compressed first signal component, said replica being supplied at an output of said data expansion means;

matrixing means having a first, a second and at least a third input; the first input being coupled to the output of said data expansion means to receive the replica of said first signal component, the second and third inputs being respectively coupled to the second and third input terminals of said transmitter to receive said second and third signal components; said matrixing means having first and second outputs for respectively supplying first and second combined output signals, the first combined output signal being a combination of a first of said two main signal components and said at least one auxiliary signal component, and the second combined output signal being a combination of the second of said two main signal components and said at least one auxiliary signal component;

second data compression means having two inputs respectively coupled to the first and second outputs of said matrixing means to receive the first and second combined output signals therefrom, said second data compression means being adapted to carry out (i) a data compression of the first combined output signal in response to a second masking control signal, and (ii) a data compression of the second combined output signal in response to a third masking control signal; the resulting data compressed first and second combined output signals being respectively supplied at two outputs of said second data compression means;

second masking control signal generator means for generating said second and third masking control signals and further generating second and third data expansion signals; the second masking control and data expansion signals being derived from the second signal component at the second input of said matrixing means, and the third masking control and data expansion signals being derived from the third signal component at the third input of said matrixing means; the second and third data expansion signals respectively relating to expansion of the data compressed first and second combined output signals produced by said second data compression means, so as to enable replicas of the first and second combined output signals to be obtained from the data compressed first and second combined output signals; and signal combining means for combining the output signals of the first and second data compression means and the first, second and third data expansion signals, so as to form a composite signal for transmission by said transmitter.

7. A transmitter as claimed in claim 6, further comprising:

calculating means coupled to the three input terminals of said transmitter for calculating (i) a first data reduction ratio corresponding to the amount of data compression which is provided by the first and second data compression means together, when said first main signal component is applied to the second input terminal and said second main signal component is applied to the third input terminal;

(ii) a second data reduction ratio corresponding to the amount of data compression which is provided by the first and second data compression means together, when said first main signal component is applied to the second input terminal and said auxiliary signal component is applied to the third input terminal; and (iii) a third data reduction ratio corresponding to the amount of data compression which is provided by the first and second data compression means together, when said auxiliary signal component is applied to the second input terminal and said second main signal component is applied to the third input terminal;

switching means coupled to the three input terminals for receiving the two main signal components and the at least one auxiliary signal component, and controlled by control signals from said calculating means to distribute said signal components among the first, second and third input terminals in conformity with whichever of said first, second and third data reduction ratios is the largest; and means comprised in said calculating means for generating a control signal indicative of which of said first, second and third data reduction ratios is the largest, and supplying said control signal to said signal combining means for inclusion in said composite signal formed for transmission by said transmitter.

8. A transmitter as claimed in claim 7, characterized in that said matrixing means comprises a control signal input for receiving the first, second and third control signals from said calculating means, and derives said first and second combined output signals from signal combinations in accordance with said control signals.

9. A transmitter as claimed in claim 6, characterized in that signal transmission is performed thereby by recording the composite output signal of the signal combining means on a record carrier.

10. A receiver for receiving a composite signal which has been transmitted by a transmitter via a transmission medium and which includes first and second data compressed main signal components, first and second data expansion instruction signals, and first and second control signals; said receiver comprising:

demultiplexer means for retrieving from said composite signal the first and second data compressed main signal components, the first and second data expansion instruction signals, and the first and second control signals;

data expansion means coupled to said demultiplexer means for carrying out a data expansion of the first data compressed main signal component in response to the first data expansion instruction signal, and for carrying out a data expansion of the second data compressed main signal component in response to the second data expansion instruction signal, thereby producing at a first output of said expansion means a replica of an original-uncompressed first main signal component and producing at a second output of said expansion means a replica of an original uncompressed second main signal component;

dematrixing means coupled to the first and second outputs of said expansion means for combining the replicas of original uncompressed first and second main signal components so as to derive therefrom a de-matrixed signal produced at an output of said dematrixing means; and switching means for receiving at a first input thereof the dematrixed signal at the output of said dematrixing means, receiving at a second input thereof the replica signal at the first output of said expansion means, and receiving at a control input thereof the first and second control signals retrieved by said demultiplexer means, wherein only one of said control signals being present at any time; said switching means having a first and a second output terminal and being controlled by said control signals so that:

(i) in response to said first control signal said switching means produces at said first output terminal thereof the dematrixed signal present at said first input of said switching means; and (ii) in response to said second control signal said switching means produces at said first output terminal thereof the replica signal present at said second input of said switching means.

11. A receiver as claimed in claim 10, characterized in that said switching means is further controlled by said control signals so that:

(iii) in response to said first control signal said switching means produces at said second output terminal thereof the replica signal present at said second input of said switching means; and (iv) in response to said second control signal said switching means produces at said second output terminal thereof the dematrixed signal present at said first input of said switching means.

12. A receiver as claimed in claim 11, wherein the received composite signal also includes a third data compressed signal component and a third data expansion instruction signal, the demultiplexer means further being adapted to retrieve the third compressed signal component from the composite signal received from the transmission medium and to supply said third compressed signal component to the expansion means, the expansion means having at least a third output, the expansion means being adapted to carry out a data expansion on the first compressed signal component in response to the first data expansion instruction signal so as to obtain a replica of the original uncompressed first signal component and to supply the replica to a first of said at least three outputs, and to carry out a data expansion on the second and third compressed signal components in response to said second and third data expansion instruction signals so as to obtain replicas of the original uncompressed second and third signal components and to supply said replicas to the second and third of said at least three outputs; the dematrixing means further having a third input coupled to the third output of said expansion means and having two outputs, the dematrixing means being adapted to combine the signals applied to its inputs so as to obtain first and second output signals for applying to said first and second outputs respectively, the switching means further comprising at least a third output terminal for supplying the third signal component, characterized in that the demultiplexer means is further adapted to retrieve the third control signal from the composite signal received from the transmission medium, the dematrixing means further having a control signal input for receiving the first, second and third control signals and being adapted to supply the replica of the first signal component to its first output and the replica of the second signal component to its second output in response to the first control signal, to supply the replica of the first signal component to its first output and the replica of the third signal component to its second output in response to the second control signal, and to supply the replica of the third signal component to its first output and the replica of the second main signal component to its second output in response to the third control signal, the switching means being adapted to receive the first and second output signals present at the first and second outputs respectively of the dematrixing means and the output signal present at the first output of the expansion means and to supply the three signals to the first, second and third output terminals such that (i) in response to the first control signal, the first and second output signals of the dematrixing means are applied to the first and second output terminals respectively, and the output signal present at the first output of the expansion means is applied to the third output terminal (ii) in response to the second control signal, the first and second output signals of the dematrixing means are applied to the first and third output terminals respectively and the output signal present at the first output of the expansion means is applied to the second output terminal, and (iii) in response to the third control signal, the first and second output signals of the dematrixing means are applied to the third and second output terminals respectively and the output signal present at the first output of the expansion means is applied to the first output terminal.

* * * * *